US005975848A

United States Patent [19]

Yu

[11] Patent Number: 5,975,848

[45] Date of Patent: Nov. 2, 1999

[54] CEILING FAN HAVING ROTARY INNER HOUSING

[76] Inventor: Jack Yu, No. 109-1, Avenue 6, Lane 164, Tzong Sa Road, Da Du Hsiang, Taichung Hsien, Taiwan

[21] Appl. No.: 09/093,982

[22] Filed: Jun. 9, 1998

[51] Int. Cl.[6] ..... F04D 29/38; F04D 29/52

[52] U.S. Cl. ..... 416/5; 416/93 R; 416/124; 416/170 R; 416/171; 416/175

[58] Field of Search ..... 416/5, 93 R, 124, 416/126, 170 R, 171, 175, 203; 417/423.14; 362/96

[56] References Cited

U.S. PATENT DOCUMENTS 4,391,570 7/1983 Stutzman ..... 416/170 R
4,626,970 12/1986 Huang ..... 416/5
5,440,459 8/1995 Chan ..... 416/5
5,441,387 8/1995 Yu .
5,454,692 10/1995 Davis ..... 416/5
5,503,524 4/1996 Yu .
5,655,877 8/1997 Yu .
5,672,048 9/1997 Yu ..... 416/5

*Primary Examiner*—Christopher Verdier

[57] ABSTRACT

A ceiling fan includes an outer housing and a cap secured on top of the outer housing. A shaft is secured to the cap and a motor is disposed in the outer housing and secured to the shaft for driving a number of fan blades. An inner housing is rotatably disposed in the outer housing and includes a center sleeve rotatably engaged on the shaft for allowing the inner housing to be rotated about the shaft and includes a number of blade members. The fan blades may generate a circulating wind through the inner housing in order to actuate the blade members.

6 Claims, 2 Drawing Sheets

CEILING FAN HAVING ROTARY INNER HOUSING

BACKGROUND OF THE INVENTION

1. Field of the Invention

The present invention relates to a ceiling fan, and more particularly to a ceiling fan having a rotary inner housing.

2. Description of the Prior Art

A typical ceiling fan is disclosed in U.S. Pat. No. 5,655,877 to YU and comprises an inner housing solidly secured in the outer housing. The inner housing may not be rotated relative to the outer housing.

The present invention has arisen to mitigate and/or obviate the afore-described disadvantages of the conventional ceiling fans.

SUMMARY OF THE INVENTION

The primary objective of the present invention is to provide a ceiling fan having an inner housing rotatably secured in the outer housing.

In accordance with one aspect of the invention, there is provided a ceiling fan comprising an outer housing, a cap secured on top of the outer housing, a shaft secured to the cap, a motor disposed in the outer housing and secured to the shaft, a plurality of fan blades secured to and driven by the motor, and an inner housing rotatably disposed in the outer housing.

The inner housing includes a self rotating means and includes a center portion having a sleeve secured thereto and, the sleeve is rotatably engaged on the shaft for allowing the inner housing to be rotated about the shaft.

A circulating wind is generated by the fan blades and flows through the inner housing and the outer housing when the fan blades are driven by the motor, and the inner housing includes a plurality of blade members for allowing the blade members to be actuated by the circulating wind and for allowing the inner housing to be rotated by the circulating wind.

One or more light bulbs are disposed in the inner housing for lighting the inner housing. A light bulb holder is secured to the shaft for supporting the light bulbs.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
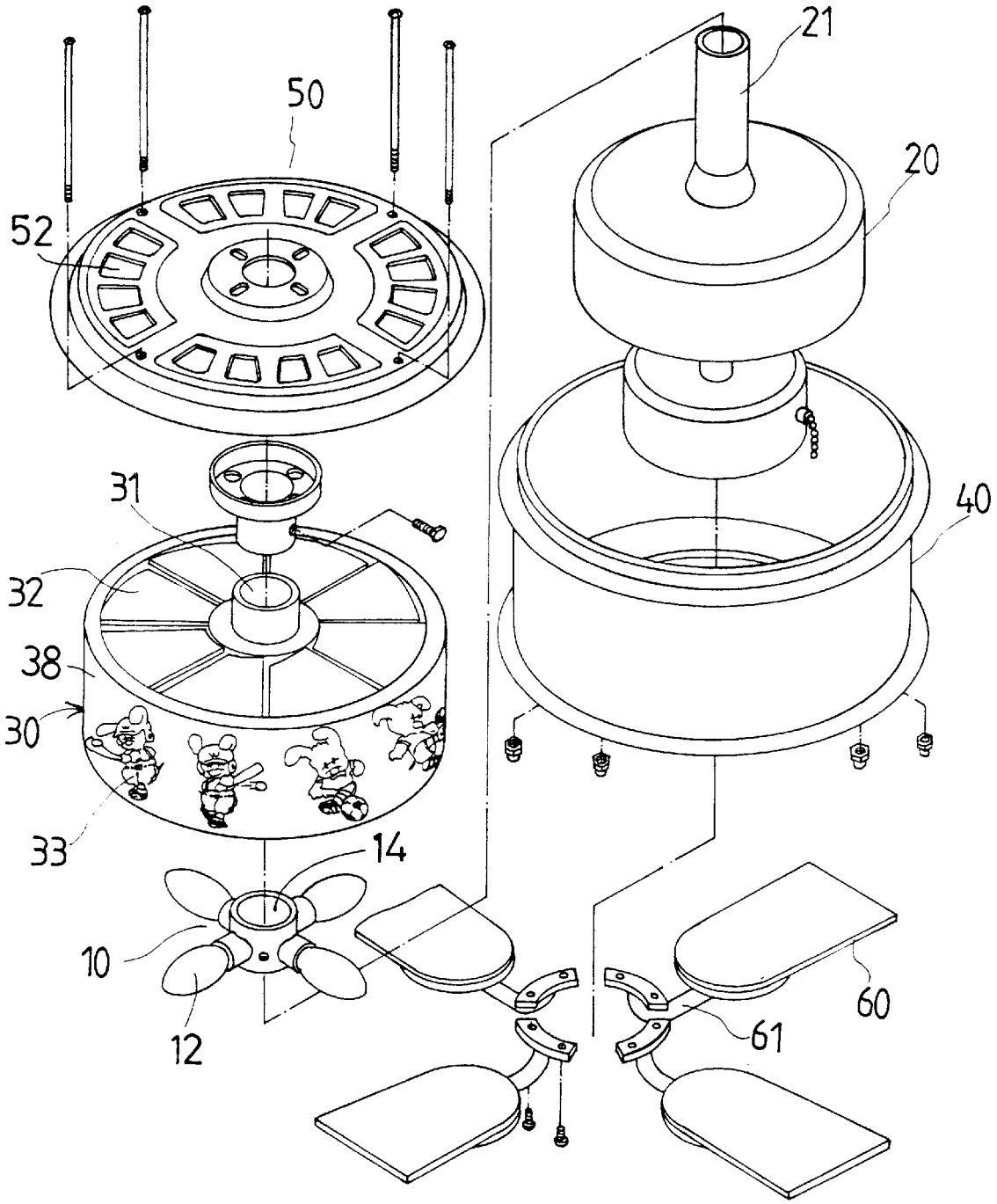
FIG. 1 is an exploded view of a ceiling fan in accordance with the present invention.
Figure 2:
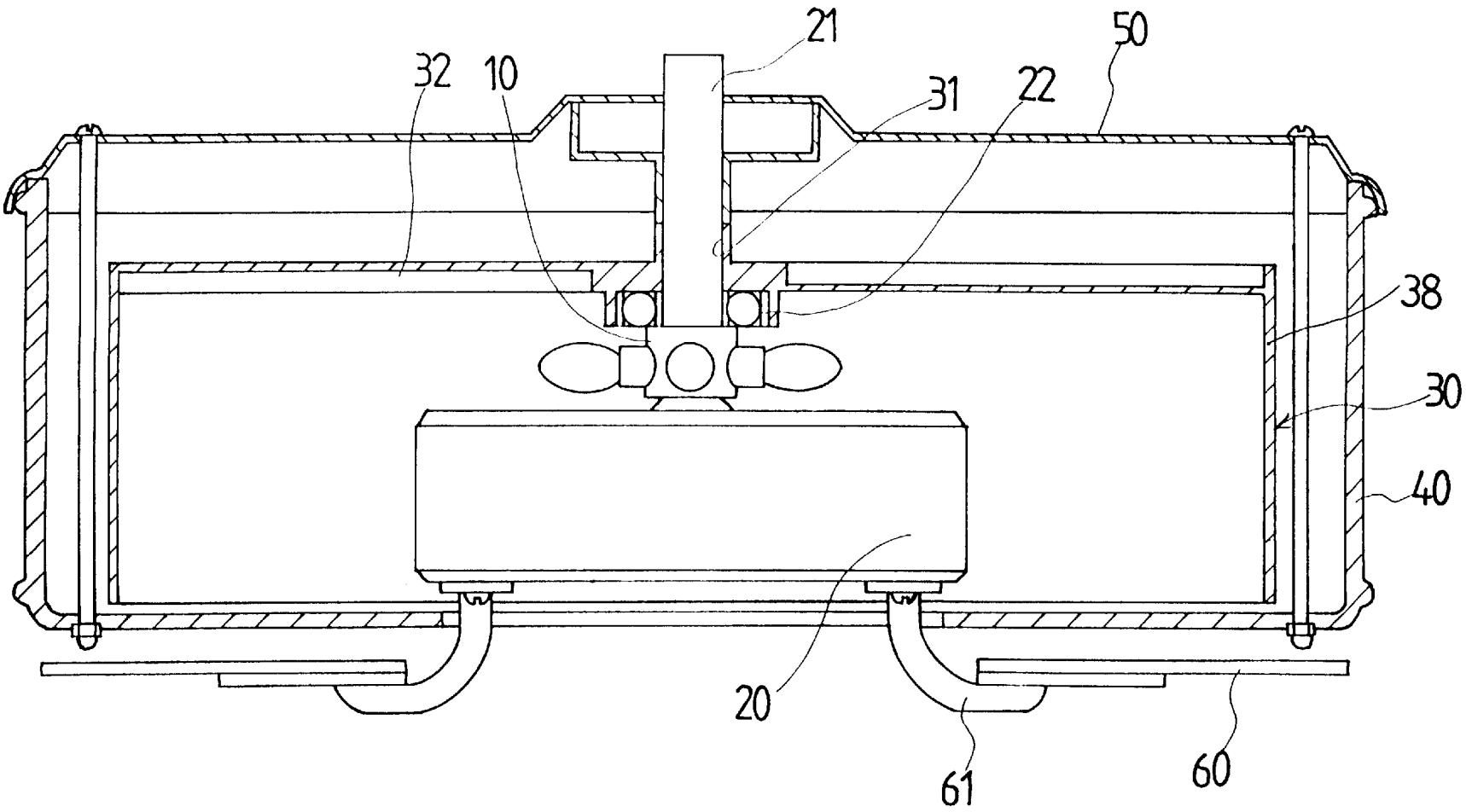
FIG. 2 is a cross sectional view of the ceiling fan.

Referring to the drawings, a ceiling fan in accordance with the present invention comprises an outer housing 40, and a cap 50 secured on top of the outer housing 40 by for example fasteners. The cap 50 includes a number of openings 52. A shaft 21 is vertically secured in the center of the cap 50. A motor 20 is secured to the shaft 21 and three or more fan blades 60 are secured to the motor 20 by brackets 61 so as to be driven by the motor 20. One or more light bulbs 12 are secured on a barrel 14 of a light holder 10, in which the barrel 14 is rotatably engaged on or secured to the shaft 21.

An inner housing 30 has a sleeve 31 provided in the center portion and rotatably engaged on the shaft 21 by bearings 22 and includes a pattern 33 applied to the inner or outer peripheral portion of an outer peripheral wall 38. The outer housing 40 is made of transparent materials, such as acrylic materials or plastic materials or glass materials, and such that the pattern 33 may be seen through the outer housing 40. The inner housing 30 includes a number of paddles or blade members 32 secured between the outer peripheral wall 38 and the sleeve 31. The blade members 32 are inclined such that the wind flowing through the housings 30, 40 may actuate and rotate the blade members 32 and thus the inner housing 33.

In operation, when the fan blades 60 are driven by the motor 20, the air from the upper portion of the ceiling fan may be drawn through the openings 52 of the cap 50 and may be drawn through the housings 30, 40 for forming a circulating wind or for forming an eddy current. The blade members 32 of the inner housing 30 may thus be actuated such that the inner housing 30 may be self rotated by the circulating wind through the housings 30, 40, and such that the pattern 33 of the inner housing 30 may be seen through the outer housing 40 in a rotary manner. The pattern 33 may further be clearly seen when the light bulb(s) 12 are energized. The blade members 32 thus form a rotating mechanism for the inner housing 30. When the fan blades 60 are rotated in a faster speed by the motor 20, the circulating wind generated by the fan blades 60 may include a faster speed. When the rotational speed of the fan blades 60 is increased or reduced, the flowing speed of the wind may thus be increased or reduced.

Accordingly, the ceiling fan includes an inner housing that may be rotatably secured in the outer housing and that may be rotated by the wind flowing through the ceiling fan.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ceiling fan comprising:

an outer housing, a cap secured on top of said outer housing, a shaft secured to said cap, a motor disposed in said outer housing and secured to said shaft, a plurality of fan blades secured to said motor and driven by said motor, and an inner housing rotatably disposed in said outer housing.

2. The ceiling fan according to claim 1, wherein said inner housing includes a self rotating means for rotating said inner housing.

3. The ceiling fan according to claim 1, wherein said inner housing includes a center portion having a sleeve secured thereto, said sleeve is rotatably engaged on said shaft for allowing said inner housing to be rotated about said shaft.

4. The ceiling fan according to claim 1, wherein a circulating wind is generated by said fan blades and flows through said inner housing and said outer housing when said fan blades are driven by said motor, said inner housing includes a plurality of blade members for allowing said blade members to be actuated by the circulating wind and for allowing said inner housing to be rotated by the circulating wind.

5. The ceiling fan according to claim 1 further comprising at least one light bulb disposed in said inner housing for lighting said inner housing.

6. The ceiling fan according to claim 5 further comprising a light bulb holder secured to said shaft for supporting said at least one light bulb.

* * * * *